United States Patent [19]

Woodruff

[11] Patent Number: 4,904,007

[45] Date of Patent: Feb. 27, 1990

[54] RELEASING LATCH ASSEMBLY FOR PICNIC COOLERS

[75] Inventor: David D. Woodruff, Wichita, Kans.

[73] Assignee: Coleman Outdoor Products, Inc., Wichita, Kans.

[21] Appl. No.: 335,049

[22] Filed: Apr. 7, 1989

[51] Int. Cl.[4] ..... E05C 19/02

[52] U.S. Cl. ..... 292/341.15; 292/DIG. 65

[58] Field of Search ..... 292/38, 44, 341.15, 292/240, 241, DIG. 38, DIG. 50, DIG. 65, DIG. 30; 439/436–439; 220/23

[56] References Cited

U.S. PATENT DOCUMENTS

| | | | |
|---|---|---|---|
| 1,742,712 | 1/1930 | Martin | 292/76 |
| 1,918,924 | 7/1933 | O'Heir | 292/76 X |
| 2,503,463 | 4/1950 | Andrew | 292/76 |
| 2,583,391 | 1/1952 | Quinn | 292/341.15 |
| 2,708,779 | 5/1955 | Tiger | 292/76 X |
| 2,823,940 | 2/1958 | Squire | 292/92 |
| 3,506,292 | 4/1970 | Hagendoorn et al. | 292/78 |
| 3,690,708 | 9/1972 | Worley et al. | 292/101 |
| 3,713,681 | 1/1973 | Worley | 292/78 |
| 3,979,007 | 9/1976 | Thornbloom, Jr. | 220/23 |
| 4,181,338 | 1/1980 | Sterling | 292/341.17 |
| 4,270,668 | 6/1981 | Berfield | 292/87 X |
| 4,630,852 | 12/1986 | White et al. | 292/DIG. 46 X |
| 4,635,977 | 1/1987 | Yamada | 292/92 |

*Primary Examiner*—Richard E. Moore

[57] ABSTRACT

A safety latch assembly for a picnic cooler includes a latch spring which is slidably mounted in a latch cover before the latch cover is attached to the lid of the cooler. The latch cover includes top, bottom, and side walls which provide a recess for the latch spring. A pair of ribs extend upwardly from the bottom wall adjacent the side walls, and a plurality of ribs extend downwardly from the top wall. The latch spring includes a flat mounting portion which is positioned between the top and bottom ribs and an L-shaped strike portion which extends downwardly from the mounting portion. The mounting portion terminates in a pair of V-shaped end portions which are positioned between the bottom ribs and the side walls of the latch cover.

10 Claims, 4 Drawing Sheets

FIG. 9
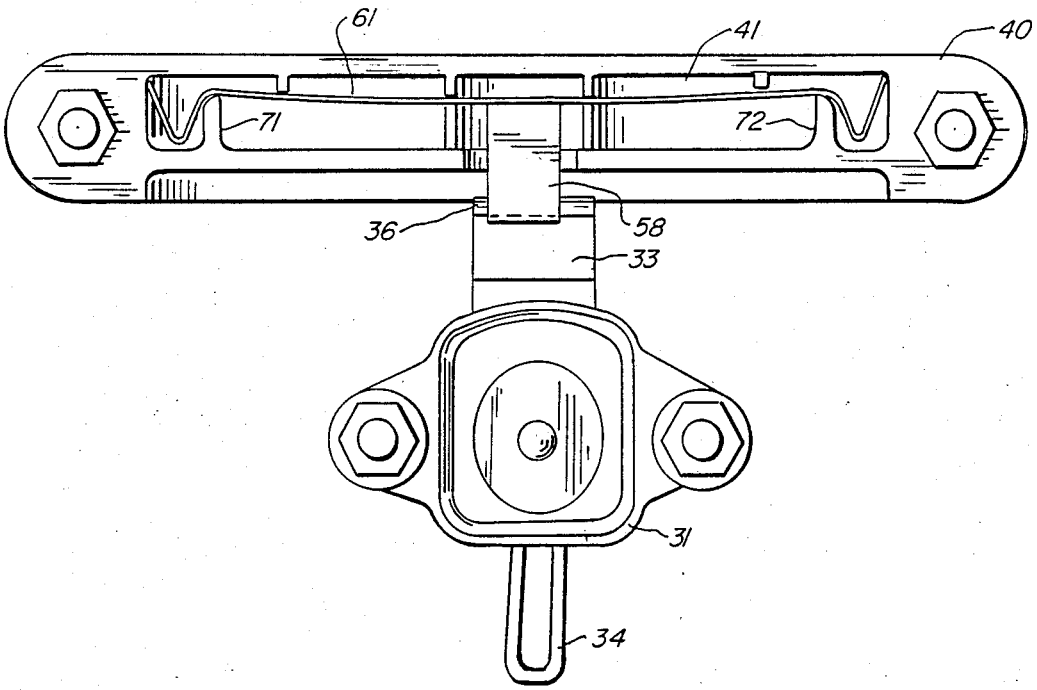
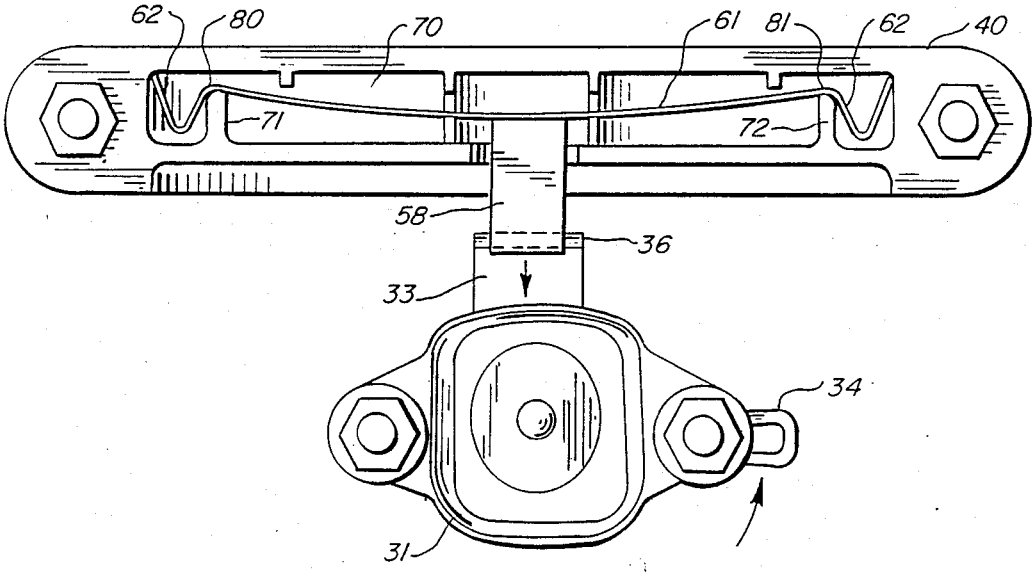
FIG. 10

FIG. 11
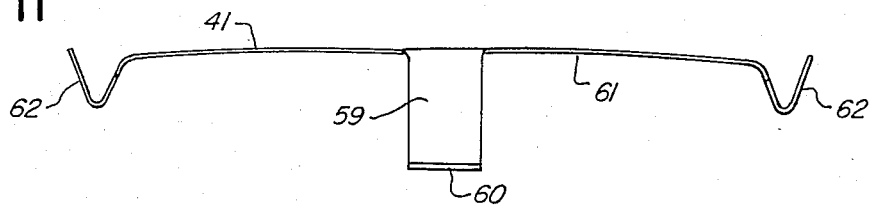
FIG. 12
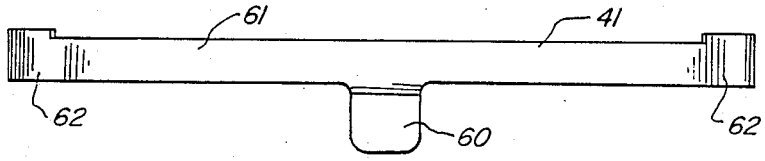
FIG. 13
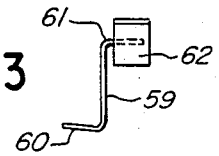
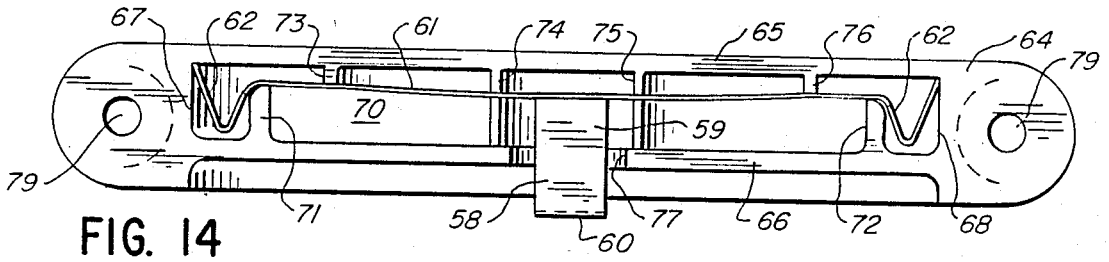
FIG. 14
FIG. 15
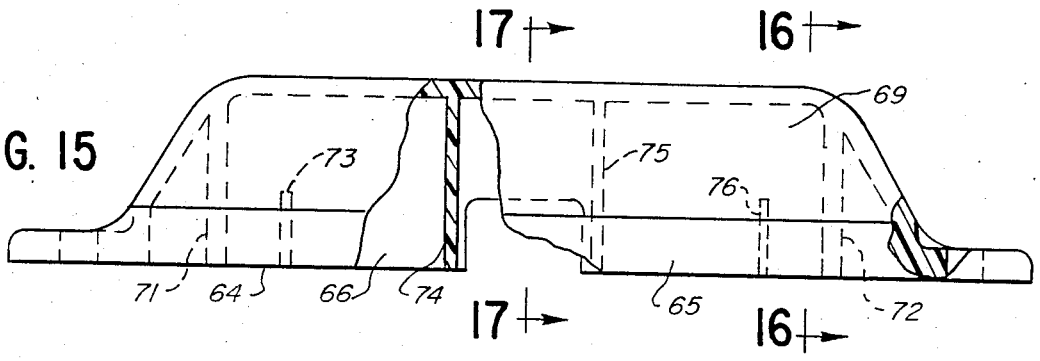
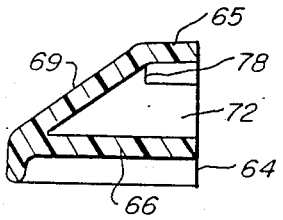
FIG. 16
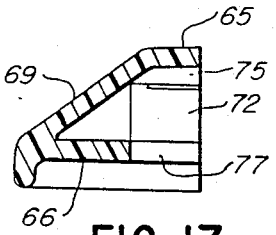
FIG. 17

RELEASING LATCH ASSEMBLY FOR PICNIC COOLERS

BACKGROUND

This invention relates to a latch assembly for coolers, and, more particularly, to a releasing latch assembly which permits the door of the cooler to be opened from the inside and prevents reclosing of the door until the latch is moved to the unlocking position.

Any enclosure having a door which can be opened only from the outside presents a hazard, particularly to children. For example, many unfortunate accidents have occurred when children have crawled into refrigerators and the door has closed behind them. Although some safety latches have been provided for refrigerator doors which permit these doors to be opened from the inside, these latches are generally not suitable for use with smaller containers such as picnic coolers because of relative expense, size, or the like.

A safety latch should hold the door securely closed and prevent inadvertent opening thereof and should also permit the door to be opened by a relative small force applied to the inside of the door. It is also desirable to provide means for preventing the door from reclosing after the safety latch is released to permit the child to escape the enclosure without further difficulty.

U.S. Pat. No. 3,690,708 describes a releasing latch assembly which includes a flexible strike. The strike is secured to the handle and the lid of the cooler by screws. The lid is locked by a latch which engages the strike. However, the lid can be opened by exerting sufficient upward force on the lid to cause the strike to flex out of engagement with the latch.

Since the strike is attached by screws, the screw holes in the strike must be aligned with the screw holes in the handle and in the lid. Any misalignments can cause delay in assembling the product. More importantly, if the screw holes are not located properly with respect to the latch, the force required to open the lid will vary.

SUMMARY OF THE INVENTION

The invention provides an improved latch assembly which compensates for misalignments and dimensional variations in the other cooler parts. Due to this, the latch provides a relatively consistent, repeatable releasing force without the need to manually bend each latch part and test each assembly on each cooler. The latch assembly includes a latch spring which includes a flexible L-shaped strike portion. The latch spring is not fixedly mounted to the lid or the handle. Rather, the latch spring is slidably positioned in the handle before the handle is attached to the lid. Since the latch spring is not attached by screws or other fasteners, it can be mounted within the handle without difficulty. The latch spring includes a flat mounting portion which is supported by a pair of ribs on the handle, and the L-shaped strike extends perpendicularly to the plane of the mounting portion. When the latch engages the strike, the flat mounting portion is flexed downwardly toward the latch. The strike is therefore positioned consistently with respect to the latch regardless of stacked tolerance of the parts of the latch assembly and misalignments between the latch spring and the lid or the latch.

DESCRIPTION OF THE DRAWINGS

The invention will be explained in conjunction with an illustrative embodiment shown in the accompanying drawings, in which—

FIG. 9 is a rear view of the latch assembly taken generally along the line 9—9 of FIG. 5;

FIG. 10 is a view similar to FIG. 9 showing the latch handle rotated to the locking position;

FIG. 11 is a front elevational view of the spring latch;

FIG. 12 is a top plan view of the spring latch;

FIG. 13 is a side elevational view of the spring latch;

FIG. 14 is a rear view of the handle and spring latch;

FIG. 15 is a top plan view, partially broken away, of the handle;

FIG. 16 is a sectional view taken along the line 16—16 of FIG. 15; and

FIG. 17 is a sectional view taken along the line 17—17 of FIG. 15.

DESCRIPTION OF THE EMBODIMENTS

Figure 1:
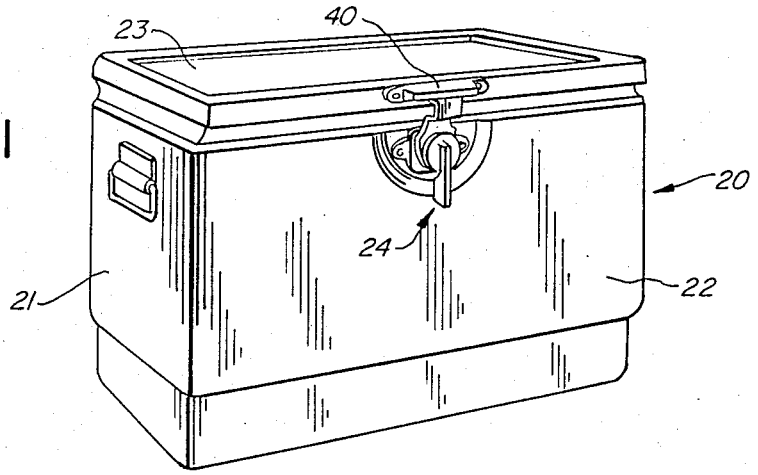
FIG. 1 is a perspective view of a picnic cooler equipped with a latch assembly formed in accordance with the invention.

The invention will be explained in conjunction with a chest-type picnic cooler 20 illustrated in FIG. 1, although it will be understood that the invention can be used with other types of coolers, for example, upright coolers, and coolers having other configurations. The cooler includes a pair of side walls 21, a front wall 22, and back and bottom walls (not shown) which provide a cooling enclosure. A lid or top 23 is hingedly secured to the back wall, and the lid can be releasably locked in the closed position by a latch assembly 24.

Figure 5:
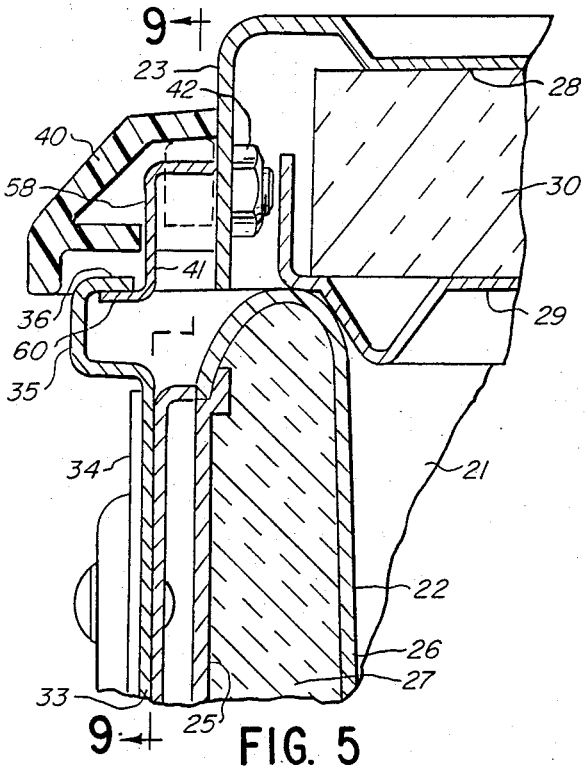
FIG. 5 is a fragmentary sectional view taken along the line 5—5 of FIG. 4, with the latch in the locking position.
Figure 6:
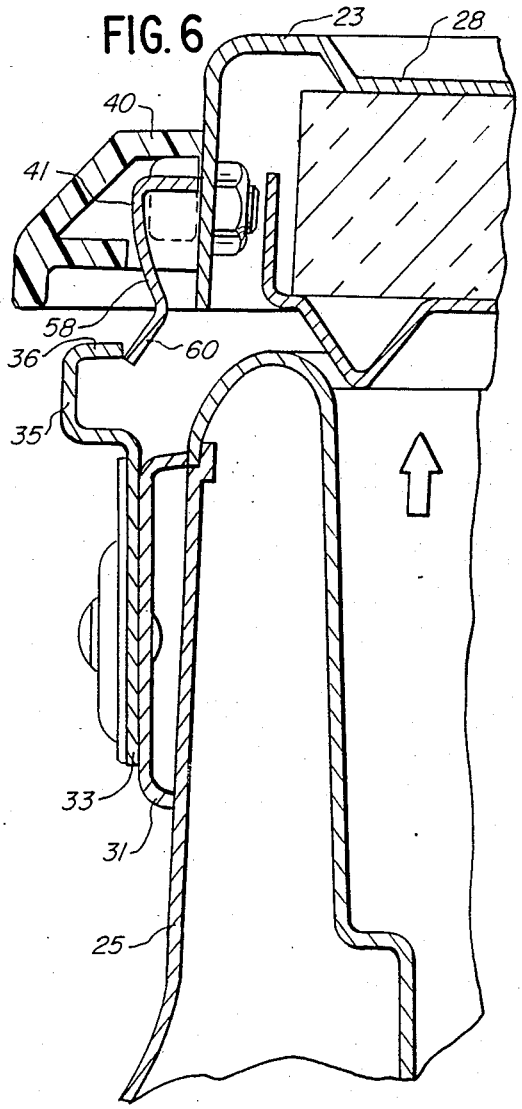
FIG. 6 is a view similar to FIG. 5 showing an upward force being applied to the lid to release the strike from the latch.

Referring to FIG. 5, the walls of the coolers are formed by an outer metal lining 25, an inner plastic tub-like liner 26, and a layer of insulating plastic foam 27 sandwiched between the liners. The lid 23 is similarly formed from an outer metal liner 28, an inner plastic liner 29, and an insulating foam layer 30. The construction details of such coolers are well known, and additional details are given in Pat. No. 3,690,708.

Figure 4:
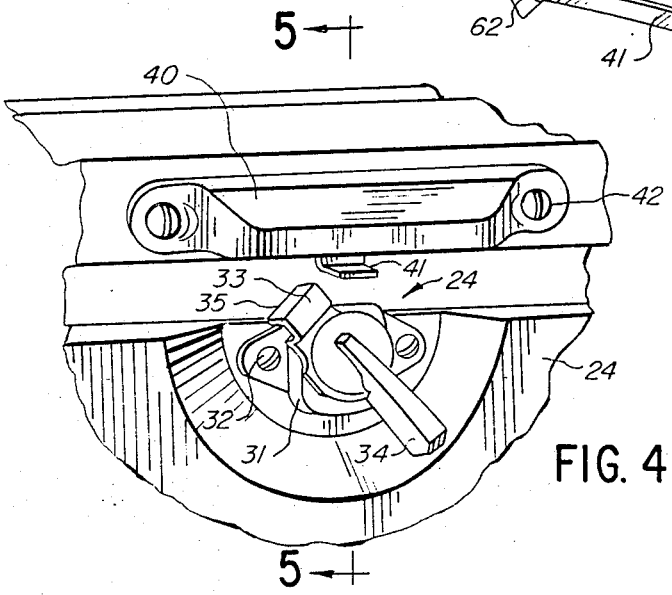
FIG. 4 is an enlarged fragmentary view of the cooler of FIG. 1 showing the latch in the unlocking position.

As can be seen best in FIG. 4, the latch assembly 24 includes a mounting base 31 which is secured to the metal liner 25 by screws 32. A latch 33 and a latch handle 34 are pivotally secured to the mounting base. The latch 33 includes a U-shaped end portion 35 which includes a generally planar keeper plate 36 (FIG. 5) extending generally perpendicularly to the front wall 22 toward the cooling enclosure.

The latch 33 and latch handle 34 are conventional, and cam members interconnect the attaching portion of the mounting base to permit the latch to be rotated with the handle when the handle is rotated between the 3 o'clock and the 6 o'clock positions as viewed in FIG. 4. When the handle is rotated to the 6 o'clock position, the keeper plate extends generally horizontally inwardly toward the cooling enclosure, and further rotation of the handle from 6 o'clock to 9 o'clock will cam the latch downwardly to draw the keeper plate vertically downwardly to a locking position. Since the camming action of the latch forms no part of the present invention, the details need not be shown.

The latch assembly also includes a handle 40 which is attached to the lid 23 and a latch spring 41 which is mounted inside the handle. As will be explained hereinafter, the latch spring is slidably mounted within the handle before the handle is secured to the lid, and the handle is secured to the lid by screws 42.

Figure 2:
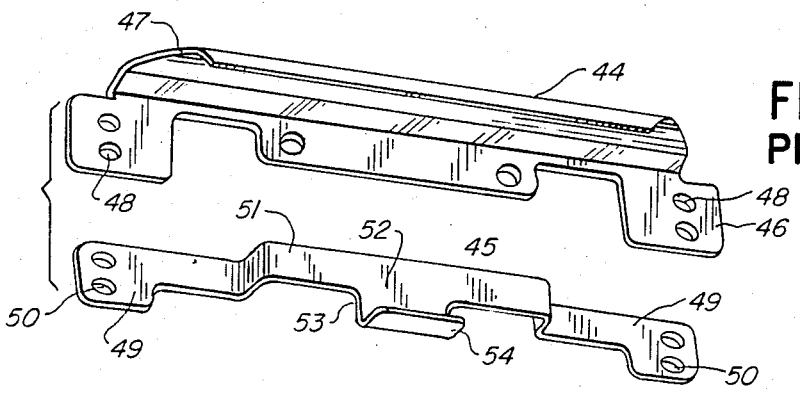
FIG. 2 PRIOR ART
FIG. 2 is an exploded perspective view of a handle and strike of a prior art latch assembly.
Figure 3:
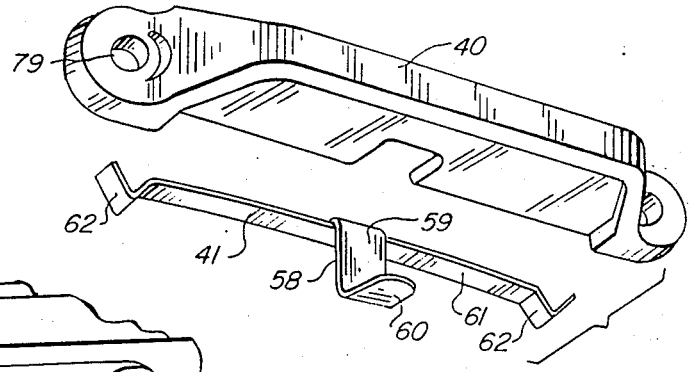
FIG. 3 is an exploded perspective view of the handle and strike of the inventive latch assembly.

A prior art handle 44 and latch spring 45 are illustrated in FIG. 2. The handle 44 includes a flat mounting plate 46 and a curved finger grip 47. A pair of screw holes 48 are provided in each end of the mounting plate. The metal latch spring 45 includes a pair of flat mounting portions 49 which are adapted to overlie the mounting plate of the handle. Screw holes 50 in the latch spring are intended to be aligned with the screw holes 48 in the handle so that the handle and latch spring are attached to the lid by the same screws.

The latch 45 includes a flat offset central portion 51 and a L-shaped strike portion 52 which extends downwardly from the central portion. The strike includes a flat flexing portion 53 which extends parallel t the plane of the central portion 51 and a foot portion 54 which extends perpendicularly to the flexing portion 53.

The strike 52 functions in the same manner as described in Pat. No. 3,690,708. However, the procedure for assembling the latch assembly is complicated by the necessity of aligning the screw holes 48 and 50. If the holes cannot be aligned, different parts must be used, or the parts must be altered. If the screw holes are located too high relative to the latch 45, the latch will flex the flexing portion 53 when the latch moves to its locking position. The force required to open the lid will thereby be reduced. The opening force will therefore vary depending upon the location of the screw holes and the tolerances of the parts of the latch assembly.

Referring to FIGS. 3 and 11–13, the inventive spring latch 41 includes a L-shaped strike portion 58 which is similar to the strike of FIG. 2 and includes a flexing portion 59 and a foot portion 60. However, the latch spring 41 includes a flat mounting portion 61 which extends in a plane which is perpendicular to the plane of the flexing portion 59. The mounting portion terminates in a pair of V-shaped end portions 62.

The handle 40 includes a back wall 64 (FIG. 14), top and bottom walls 65 and 66, side walls 67 and 68, and an inclined front wall 69 which form an enclosure 70 for the latch spring. A pair of ribs 71 and 72 extend upwardly from the bottom wall adjacent the side walls 67 and 68, and four ribs 73–76 extend downwardly from the top wall.

The vertical spacing between the bottom ribs 71 and 72 and the top ribs 73–76 is substantially the same as the thickness of the mounting portion 61 of the latch spring 41. The latch spring is mounted within the handle 40 by sliding the latch spring into the enclosure 70 of the handle so that the mounting portion 61 is positioned between the bottom and top ribs 71–76 and the V-shaped end portions 62 are positioned in the compartments formed between the bottom ribs 71 and 72 and the side walls 67 and 68. The mounting portion 61 is supported by the bottom ribs 71 and 72 adjacent the V-shaped end portions 62. The strike portion 58 extends downwardly through a slot 77 in the bottom wall 66 of the handle. Referring to FIG. 16, the bottom ribs 71 and 72 are provided with upwardly extending shoulders 78 which provide a forward stop for positioning the mounting portion 61 of the latch spring relative to the back of the handle.

In one specific embodiment the spring latch 41 was formed from 0.020 inch thick C1050 annealed spring steel. The mounting portion 61 was 0.24 inch wide. The shank portion 59 of the strike was 0.60 inch long and 0.50 inch wide, and the included angle between the shank portion and the mounting portion was 88°. The foot portion 60 was 0.30 inch long and was angled upwardly so that the included angle between the foot portion and the shank portion was 84°. The handle 40 was molded from polypropylene. The vertical spacing between the bottom and the top ribs 71–76 was 0.020 inch, and the dimension between the back of the handle and the shoulders 78 was 0.280 inch.

After the latch spring is mounted within the handle, the handle is secured to the lid by screws 42 (FIG. 4) which pass through screw holes 79 in the handle. The lid closes the enclosure 70 within the handle, and the spring latch is thereby retained within the handle.

Since the spring latch is not secured to the handle, there is no need to align screw holes in the spring latch with screw holes in the handle. Even if the dimensions of the spring latch and the handle are not perfectly matched, the spring latch can be easily inserted by slight flexing.

FIGS. 5–8 illustrate the operation of the latch assembly. The lid is closed by first rotating the latch handle 34 counter-clockwise from the 6 o'clock position to bring the latch 33 out of the locking position as illustrated in FIG. 4. After the door is closed, the latch handle can be returned to the 6 o'clock position to bring the keeper plate 36 above the foot portion 60 of the strike. The inner edge of the keeper plate extends inwardly beyond the outer edge of the foot portion, and further clockwise rotation of the latch handle will cam the keeper plate downwardly into firm engagement with the foot portion as shown in FIGS. 5 and 10.

Figure 7:
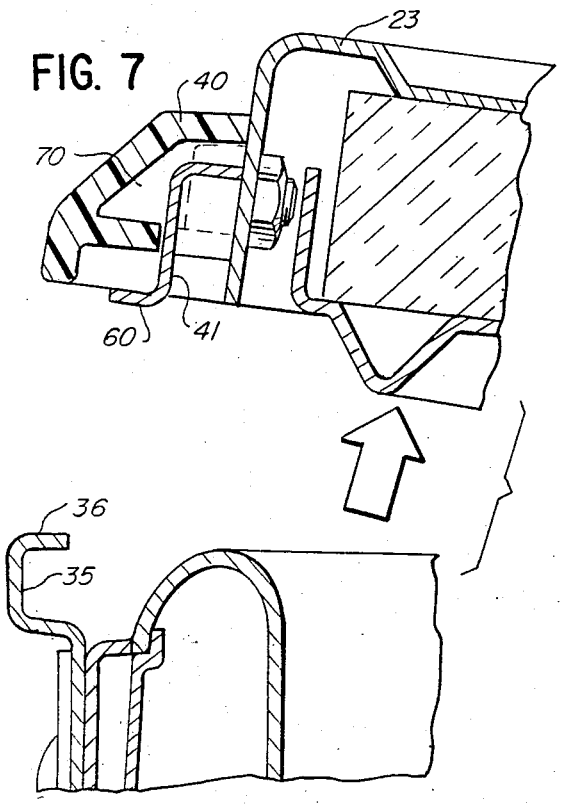
FIG. 7 is a view similar to FIG. 6 showing the lid being raised after the strike is released.

The engagement of the keeper plate with the strike holds the door normally closed and prevents inadvertent opening thereof. However, the strike is formed of flexible and resilient material such as plastic, spring steel, and the like, and the door can be opened when sufficient force is applied to the inside of the door in the direction of the arrow will cause the foot portion of the strike to exert an upward force on the keeper plate 36. The latch is made of relatively rigid material such as metal, and the keeper plate 36 will maintain its horizontal position. If the upward force applied to the door is of sufficient magnitude, the shank portion 58 will flex inwardly to permit the foot portion 59 to pull away from the keeper plate. When the outer end of the foot portion passes the inner end of the keeper plate, the door can swing freely open as shown in FIG. 7, and the resilient strike will return to its original unflexed position.

Figure 8:
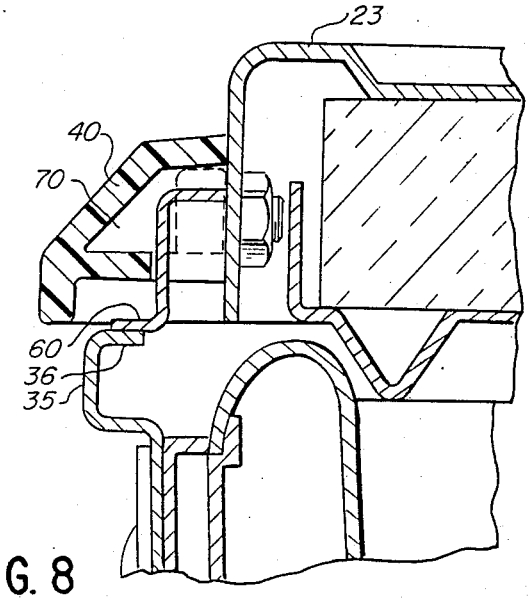
FIG. 8 is a view similar to FIG. 5 showing the strike preventing the lid from being reclosed.

After the door has been forced open, the door will not completely close until the latch is moved out of the locking position. Referring to FIG. 8, when the door swings downwardly, the foot portion of the strike, which has returned to its original position, will engage the top of the keeper plate and prevent the door from fully closing and being relatched. When it is desired to relock the door in the closed position, the latch handle need merely be rotated to bring the keeper plate out of the locking position and to permit the strike and the door to move downwardly into the fully closed position. Thereafter, the keeper plate can be returned to engage the upper side of the foot portion of the strike.

FIG. 9 illustrates the position of the latch spring after the latch handle 34 has been rotated into the 6 o'clock position to position the keeper plate 36 of the latch above the foot portion 60 of the strike. Further rotation of the latch handle to the 9 o'clock position (FIG. 10, as viewed from the back) will cam the keeper plate 36 downwardly, causing the mounting portion 61 of the latch spring to flex downwardly between the supporting ribs 71 and 72 of the handle. The V-shaped end portions 62 of the latch spring engage the ribs 71 and 72 and are retained within the compartments between the ribs and the side walls of the handle.

The flat mounting portion 61 of the latch spring flexes readily under a force which is applied perpendicularly to its plane. When the keeper plate 36 pulls the latch spring downwardly, the latch spring will flex preferentially in the mounting portion and substantially no flexing occurs between the foot portion 60 and the shank portion 59. Accordingly, even if the desired relative positions of the latch spring and the latch were not attained during assembly, the foot portion of the latch spring will not flex during locking of the lid.

After the lid is locked and an upward opening force is exerted against the lid, some additional downwardly flexing of the mounting portion 61 might occur. However, very little force is required before the surfaces 80 and 81 come into contact with the radius on ribs 71 and 72. This halts the downward flexing of the mounting portion 61. Accordingly, substantially all of the upward force is directed to flexing the shank portion 58 of the strike to permit the foot portion 59 to pull away from the keeper plate 36 of the latch. The latch spring therefore provides a relatively consistent, repeatable opening force regardless of misalignment, tolerances, etc. between the various parts of the latch assembly and dimensional variations in other parts of the cooler. After the strike is released from the keeper plate, the resilient mounting portion returns to its original, unflexed position.

While in the foregoing specification, a detailed description of a specific embodiment of the invention was set forth for the purpose of illustration, it will be understood that many of the details herein given may be varied considerably by those skilled in the art without departing from the spirit and scope of the invention.

I claim:

1. A safety latch assembly for a cooler having a container body and a lid, the safety latch assembly including a handle mounted on the lid and being provided with a recess which opens toward the lid and which is closed by the lid when the handle is mounted on the lid, a flexible and resilient latch spring position within the recess in the handle and being retained within the handle by the lid, the latch spring including a mounting portion which is slidably positioned within the recess of the handle before the handle is mounted on the lid and a strike portion which extends downwardly from the mounting portion and the handle.

2. The safety latch assembly of claim 1 in which the handle includes a bottom wall and a pair of ribs which extend upwardly from the bottom wall for supporting the mounting portion of the latch spring.

3. The latch assembly of claim 2 in which the mounting portion of the latch spring includes a pair of end portions which extend downwardly adjacent said ribs.

4. The latch assembly of claim 2 in which the handle includes a top wall and a plurality of ribs which extend downwardly from the top wall, the vertical spacing between the top and bottom ribs being approximately the same as the thickness of the mounting portion of the latch spring whereby the latch spring is slidably retained between the top and bottom ribs.

5. The latch assembly of claim 1 in which the mounting portion of the latch spring is generally planar and extends across the upper ends of the bottom ribs.

6. The latch assembly of claim 5 in which the strike portion of the latch spring is generally L-shaped and includes a shank portion which extends perpendicularly to the mounting portion and a foot portion.

7. The latch assembly of claim 1 in which the handle includes top, bottom and side walls which define said recess and a pair of ribs which extend upwardly from the bottom wall adjacent the side walls to provide a pair of side compartments between the ribs and the side walls, the mounting portion of the latch spring being supported by the ribs and terminating in a pair of end portions which extend downwardly into said side compartments.

8. The latch assembly of claim 7 in which the end portions of the latch spring are generally V-shaped.

9. The latch assembly of claim 7 in which the handle includes a plurality of ribs which extend downwardly from the top wall, the vertical spacing between the top and bottom ribs being approximately the same as the thickness of the mounting portion of the latch spring whereby the latch spring is slidably retained between the top and bottom ribs.

10. The latch assembly of claim 7 in which the mounting portion of the latch spring is generally planar and extends across the upper ends of the bottom ribs and the strike portion is generally L-shaped and includes a shank portion which extends perpendicularly to the mounting portion and a foot portion.

* * * * *